US010328483B2

(12) United States Patent
LeVey et al.

(10) Patent No.: US 10,328,483 B2
(45) Date of Patent: Jun. 25, 2019

(54) METHOD AND APPARATUS FOR COLD FORMING THREAD ROLLING DIES

(71) Applicant: ILLINOIS TOOL WORKS INC., Glenview, IL (US)

(72) Inventors: Kenneth R. LeVey, Winfield, IL (US); Michael J. Marchese, III, Chicago, IL (US); Thomas S. King, St. Charles, IL (US)

(73) Assignee: Illinois Tool Works Inc., Glenview, IL (US)

( * ) Notice: Subject to any disclaimer, the term of this patent is extended or adjusted under 35 U.S.C. 154(b) by 290 days.

(21) Appl. No.: 14/432,498

(22) PCT Filed: Sep. 11, 2013

(86) PCT No.: PCT/US2013/059227

§ 371 (c)(1),
(2) Date: Mar. 31, 2015

(87) PCT Pub. No.: WO2014/055209

PCT Pub. Date: Apr. 10, 2014

(65) Prior Publication Data

US 2015/0266083 A1 Sep. 24, 2015

Related U.S. Application Data

(60) Provisional application No. 61/708,939, filed on Oct. 2, 2012.

(51) Int. Cl.
*B21H 3/02* (2006.01)
*B21H 3/06* (2006.01)

(52) U.S. Cl.
CPC ..... *B21H 3/06* (2013.01); *B21H 3/02* (2013.01)

(58) Field of Classification Search
CPC . B21H 3/02; B21H 3/022; B21H 3/04; B21H 3/06; B21H 8/00; B21H 8/005;
(Continued)

(56) References Cited

U.S. PATENT DOCUMENTS 926,253 A * 6/1909 Hyde ..... B21D 22/10 72/207
1,579,308 A 4/1926 Graham
(Continued)

FOREIGN PATENT DOCUMENTS

CN 202174198 3/2012
DE 566294 C 3/1933
(Continued)

OTHER PUBLICATIONS

Translation, FR 2636869 A1, Mar. 1990.*
(Continued)

*Primary Examiner* — Edward T Tolan
(74) *Attorney, Agent, or Firm* — Quarles & Brady LLP

(57) ABSTRACT

A method is disclosed for roll forming the face pattern onto a pattern forming die having a pattern receiving face, using an initial, and subsequent, pattern forming tool, each with a generally cylindrical pattern defining surface, by relatively and sequentially reciprocating and rotating the pattern defining surfaces and the pattern receiving face while engaging them and urging them to impress the pattern of the pattern defining surfaces into the pattern receiving face of the forming die blank. An apparatus for performing the process is disclosed which includes a platen for the pattern forming die, initial and subsequent pattern forming tools each having a generally cylindrical pattern defining surface, a drive mechanism for relatively and sequentially reciprocating and rotating the pattern defining surfaces and the pattern receiving face of the forming die blank, and relative movement
(Continued)

mechanism for engaging the surfaces to impress the pattern of the pattern defining surfaces of the pattern forming tools into the pattern receiving face of the forming die blank.

26 Claims, 7 Drawing Sheets

(58) Field of Classification Search
CPC .... B21H 3/00; B21H 7/14; B44B 5/00; B44B 5/0009; B44B 5/0019; B44B 5/0047; B21B 1/04; B21B 1/0805; B21B 2001/081; B21B 1/227
USPC ..... 72/88, 90; 101/6, 23
See application file for complete search history.

(56) References Cited

U.S. PATENT DOCUMENTS

| | | | | | |
|---|---|---|---|---|---|
| 2,364,442 | A * | 12/1944 | Hoern | B21H 3/06 | 72/90 |
| 2,569,350 | A * | 9/1951 | Smith | B41B 5/08 | 199/1 |
| 2,607,935 | A * | 8/1952 | Archer | B21H 3/02 | 408/215 |
| 2,699,077 | A | 1/1955 | Bedker | | |
| 2,875,649 | A | 3/1959 | Bedker | | |
| 3,017,697 | A * | 1/1962 | Wlodek | C21D 7/04 | 42/78 |
| 3,166,008 | A * | 1/1965 | Lewandoski | B41B 1/10 | 101/269 |
| 3,201,964 | A * | 8/1965 | Walters | B21H 3/04 | 66/9 A |
| 3,327,569 | A | 6/1967 | Prutton | | |
| 3,405,545 | A * | 10/1968 | Orlomoski | B21H 3/06 | 72/469 |
| 3,415,091 | A * | 12/1968 | Grob | B21H 3/04 | 72/104 |
| 3,638,514 | A * | 2/1972 | Carpenter | B21H 3/027 | 72/214 |
| 3,646,794 | A * | 3/1972 | Tishken | B21H 8/005 | 72/187 |
| 3,685,328 | A * | 8/1972 | Carpenter | B21H 3/027 | 470/10 |
| 3,686,911 | A * | 8/1972 | Plagemann | B21H 3/00 | 72/108 |
| 3,996,780 | A * | 12/1976 | German | B21H 8/00 | 72/187 |
| 4,028,921 | A * | 6/1977 | Blue | B21H 5/027 | 29/402.01 |
| 4,092,842 | A * | 6/1978 | Oser | B21D 13/04 | 428/174 |
| 4,170,050 | A * | 10/1979 | Bosse | B21H 3/08 | 411/178 |
| 4,926,566 | A * | 5/1990 | McMurtry | G01B 3/004 | 33/493 |
| 6,324,887 | B1 * | 12/2001 | Sharp | B21H 3/06 | 72/469 |
| 6,588,333 | B1 * | 7/2003 | Homer | B44B 5/0009 | 101/23 |
| 2004/0112104 | A1 * | 6/2004 | Scamans | B21B 1/227 | 72/187 |

FOREIGN PATENT DOCUMENTS

| | | | | |
|---|---|---|---|---|
| DE | 567538 | C | 4/1933 | |
| DE | 1602678 | A1 | 12/1970 | |
| FR | 2636869 | A1 * | 3/1990 | B21H 7/14 |
| JP | 59-54439 | A * | 3/1984 | B21H 5/00 |
| JP | 10-166096 | | 6/1998 | |
| JP | 2009-214153 | | 9/2009 | |

OTHER PUBLICATIONS

ISR and WO for PCT/US2013/059227 dated Dec. 20, 2013.
Machine translation of JP 10-166096.
Machine translation of JP 2009-214153.

* cited by examiner

METHOD AND APPARATUS FOR COLD FORMING THREAD ROLLING DIES

CROSS-REFERENCE TO RELATED APPLICATIONS

This application is a national phase of International Application No. PCT/US2013/059227 filed Sep. 11, 2013 and claims priority to U.S. Provisional Application No. 61/708,939, filed Oct. 2, 2012, the entire contents of which are hereby incorporated by reference herein as if fully set forth.

BACKGROUND

This disclosure relates to the roll forming of dies used to manufacture threaded fasteners or other patterned cylindrical articles. More particularly, it relates to the apparatus and method for forming the pattern on the dies using a cold forming machine and process.

Thread forming dies used in thread rolling are universally produced using milling and grinding equipment. Such operations usually take hours to produce a die set. Also, milling and grinding produces dies having a rough surface.

Typically thread forming tooling includes a stationary die and a moveable die. The face of the moving die is planar. The face of the stationary die is contoured to provide specific areas of engagement with the blank being formed into a fastener. The die blank 50 is M-2 tool steel fully annealed having a hardness of Rockwell 20 to 30. After forming the thread pattern on the die blank, it is heat treated to a hardness of Rockwell C-60.

The die blanks are rectangular blocks of steel with die faces impressed with a thread rolling pattern. To extend useful die life, the thread rolling pattern is created on both faces of the die blank. Once a given face is worn, the die block is rotated one hundred eighty degrees (180°) to present a fresh thread forming pattern.

The root sharpness specification for dies has traditionally been driven by die manufacturing limitations. Mills and grinding wheels have a minimum capability to hold a fine tip, and as the tip to be formed on a die gets sharper, their lifespan decreases dramatically.

It has been determined that thread rolling dies may be produced by cold forming die blanks with the ridges defining the thread pattern. Disclosed is a machine and process of reduced complexity and increased speed (minutes vs. hours). The resultant thread forming die is of close tolerance and high wear resistance.

It must be understood that the cold forming of thread defining ridges on a thread rolling die as disclosed herein is merely exemplary of the capabilities of the equipment, and process disclosed. It is contemplated that the process and equipment is suitable for other uses where deforming metal to provide a pattern upon a surface is the desired result.

SUMMARY OF THE DISCLOSURE

In the development of the disclosed thread die cold forming process and the equipment to produce cold formed thread rolling dies, several important process limitations and consequences were recognized.

First, it was recognized that it is necessary to roll a round tool longitudinally across the surface of the workpiece rather than trying to stamp threads onto it with a flat die moving perpendicular to the die face. Longitudinal movement of a cylindrical die allows the tool to form the thread pattern in concentrated regions, gradually propagating the shape across the die face. Much greater material flow can be achieved through this rolling motion than stamping.

The direction of rolling must be at a low angle with respect to the direction of the threads which are nearly parallel to the longitudinal edge of the blank. Using a tool with a sufficiently large diameter, it is possible to roll parallel to the edge of the workpiece rather than parallel to the threads themselves. The resultant tooling includes helical ridges like a screw, as opposed to annular ridges in the form of annular rings. This makes the process practical even for complex threadforms. For example, dies for screws that have special threads at the tip can be formed all at once instead of one thread at a time, as conventional methods require.

Second, it was recognized that the tool must be rolled over the workpiece multiple times, gradually developing deeper and deeper threads. This keeps the stress in the tool low enough to prevent breakage, spreading the work out over many small passes. It is possible to develop a regimen in which a certain number of passes are made, each at a certain, gradually increasing, downward force.

Third, it was determined that it was necessary to trap the workpiece rigidly along the two longitudinal sides parallel to the direction of rolling. Without such confinement, workpiece material flows sideways, perpendicular to the threads on the tool, breaking them along the edge of the die face. Preventing this sideways material flow protects the tool and enables the workpiece material to flow up into the threads of the tool and develop into the correct shape.

Fourth, it was concluded that a sixty degree (60°) threadform (the angle of the threads on all machine screws) is too blunt to be fully formed with a single tool, even after utilizing the concepts of rolling with multiple passes. No matter how many passes are made, there is a limit to how much the threadform can be developed. Therefore, it is necessary to use multiple tools in sequence. First, a pre-form threadform is applied, such as one with a thirty degree (30°) or forty-five degree (45°) angle. Such a shape can be formed with full thread depth into the die face. Then, a second tool with the final sixty degree (60°) threadform can be used to finish the desired shape of the thread forming ridges of the final die configuration.

A secondary consequence of using multiple tools in sequence (such as ones with 30° and 60° threads) is that the thread on the workpiece that is left by first tool can be further deformed by the second tool to form a shape on the workpiece that is different from the shape of either tool. This can produce threadforms that would otherwise be impossible to achieve, either through forming or conventional methods. One example is a sharper root, which enhances die performance beyond that of dies made with conventional methods. The deeper die root allows the threads being rolled onto a screw blank to expand freely instead of eventually touching the root of the die. This results in a final screw product with less crest damage due to contact with the die root. It also extends die longevity.

It has also been determined that the coefficient of friction between the cylindrical tool and workpiece is very important in terms of the number of passes required to develop the thread form on the die and the lifespan of the cold forming tool. Also, specific coatings on the tool make a large difference in performance. Therefore, it is contemplated that the cold forming tool be coated with a hard, smooth, carbon based coating.

Cold forming of thread dies can be carried out on simple, inexpensive, relatively small machines, especially when compared, for example, to crush grinders. And, cold forming does not require coolant, or remove material, which is a coolant contaminant. Moreover, with cold forming, each tool can create multiple dies before being to be replaced or reshaped, unlike mills and grinding wheels.

The disclosed cold forming process utilizes force control rather than dimensional positioning, for shape formation onto a die blank. This permits the tooling to follow complex die contours easily and accurately without the need for complicated fixturing, setup, and machine programming. Moreover, as explained later, it is contemplated that multiple die faces may be processed simultaneously.

The die of the disclosed cold forming process has a very smooth finish thereby reducing friction during use, and extending die life. The smooth finish also contributes to manufacture of fastener products with lower tolerance variation.

With cold forming, the final die root shape can be sharper than the forming tools used to create it. As a result, the die root sharpness specification may be based on die life considerations rather than the frailties of the tools used to make the dies.

In this regard, a method is disclosed for roll forming the face pattern onto a pattern forming die having a pattern receiving face, using an initial, and subsequent, pattern forming tool, each with a generally cylindrical pattern defining surface, by relatively and sequentially reciprocating and rotating the pattern defining surfaces and the pattern receiving face while engaging them and urging them to impress the pattern of the pattern defining surfaces into the pattern receiving face of the forming die blank. An apparatus for performing the process is disclosed which includes a platen for the pattern forming die, initial and subsequent pattern forming tools each having a generally cylindrical pattern defining surface, a drive mechanism for relatively and sequentially reciprocating and rotating the pattern defining surfaces and the pattern receiving face of the forming die blank, and relative movement mechanism for engaging the surfaces to impress the pattern of the pattern defining surfaces of the pattern forming tools into the pattern receiving face of the forming die blank.

DETAILED DESCRIPTION OF ILLUSTRATED EMBODIMENTS

Figure 1:
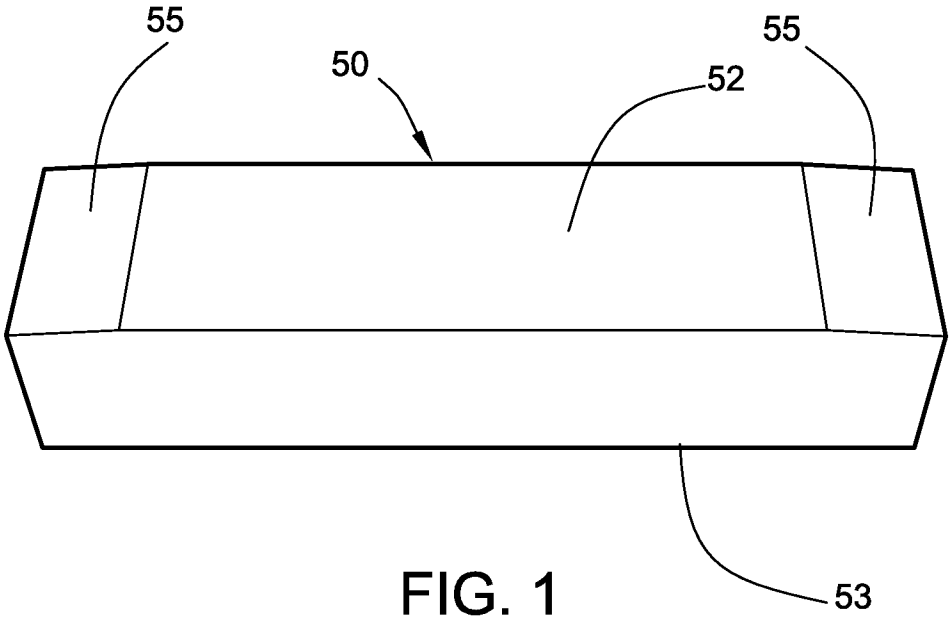
FIG. 1 is a side perspective view of a blank for a thread forming die.

A die blank or die block 50 to be processed is illustrated in FIG. 1. The oppositely facing front and back elongate pattern receiving faces 52 and 53 of the die blank are plain. These rectangular faces receive the thread forming ridges which, in use, impart a rolled thread to a cylindrical fastener blank. Opposite longitudinal ends of face 52 may include a slight taper 55 of about five degrees (5°) for roll-on and roll-off of a blank to be formed during thread rolling.

Figure 2:
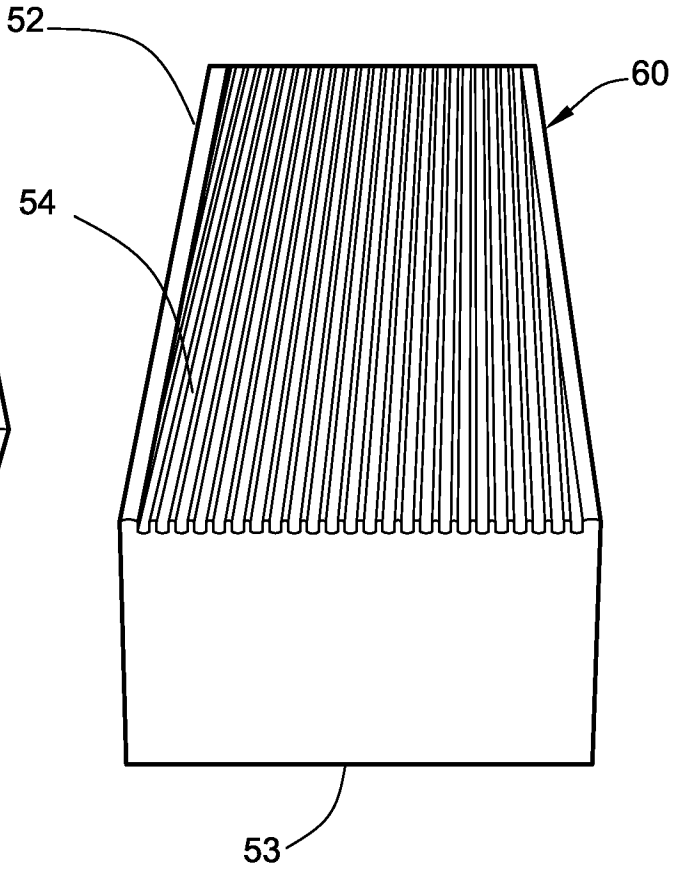
FIG. 2 is an end perspective view of a thread forming die produced by cold forming employing the disclosed device and process.

FIG. 2 illustrates a completed thread forming die 60 to be used in roll forming threaded fasteners such as machine screws. Here face 52 is impressed with a thread form pattern 54 that progresses in a spiral pattern longitudinally along the face 52. A similar ridge pattern may be provided on face 53 as well.

Figure 3:
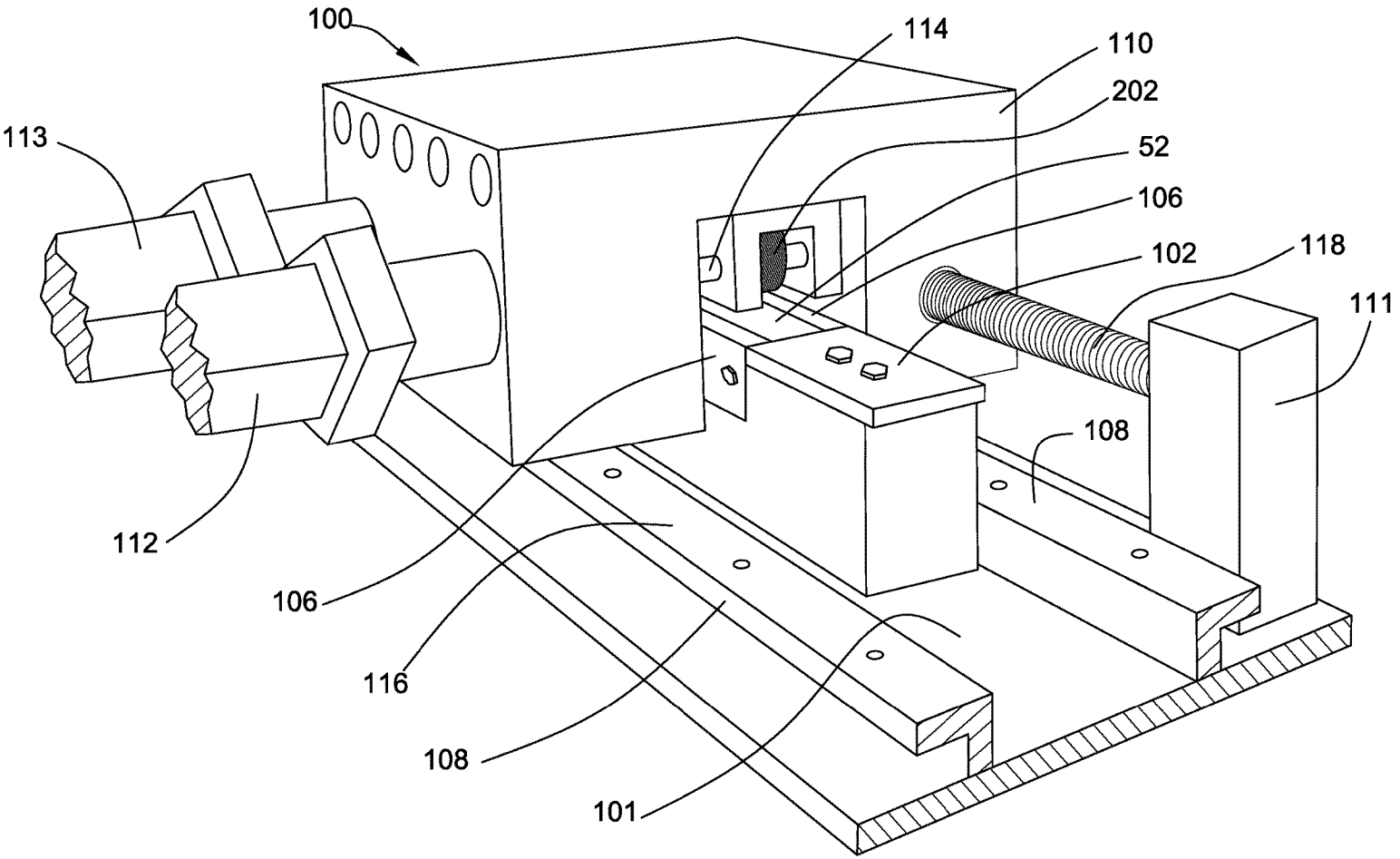
FIG. 3 is a perspective view of the thread forming apparatus of the present disclosure.

A machine for cold rolling thread forming dies is seen in FIG. 3. The machine 100 is illustrated somewhat schematically in FIGS. 4 and 5. Machine 100 comprises relative movement mechanism, drive mechanism, and tooling.

Figure 4:
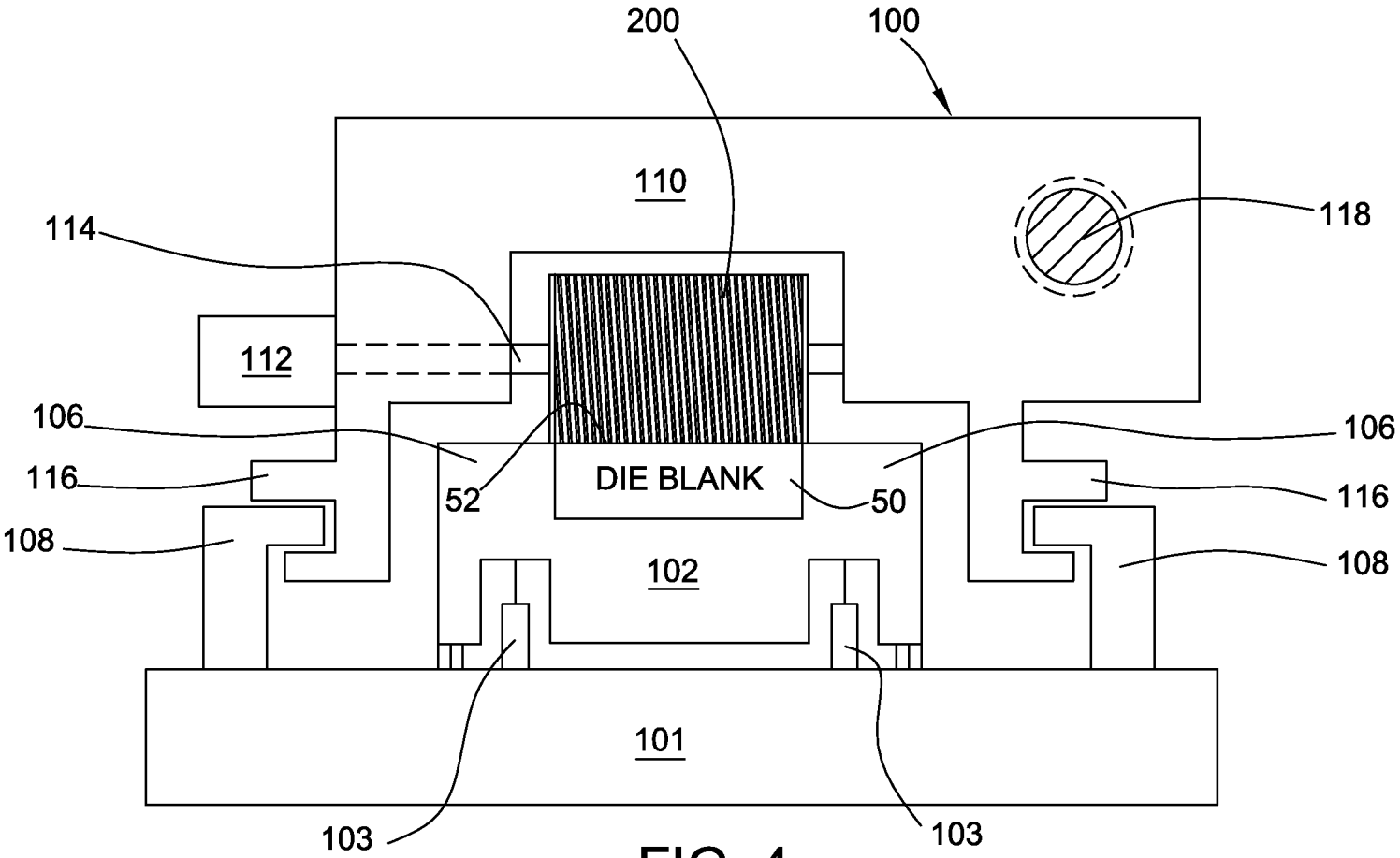
FIG. 4 is a side view of the thread forming apparatus of the present disclosure.

Referring to FIGS. 3 and 4, machine 100 includes a base 101, supporting a platen 102 which is an element of the relative movement mechanism. It supports a die blank 50 for processing by rotatable cylindrical tools 200 and 300 which are employed sequentially as will be explained. The platen 102 includes vertical side blocks 106 that support the longitudinal edges of the die blank 50.

The base 101 includes longitudinal rails 108. A longitudinally slidable head 110 is slidably supported on rails 108 of base 101 by interengaged rails 116 shown in FIG. 4. Drive mechanism includes a linear actuator driven by a servo motor 111 (See FIG. 3) includes a rotatable threaded shaft 118 supported on base 101 and threaded follower block within head 110. It provides reciprocal movement of head 110 by activation of the servo motor 111. The path of reciprocal movement is sufficiently long for the tool 200 or 300 to traverse the entire surface 52 of die blank 50.

As illustrated in FIG. 4, positioning mechanism includes vertically movable by hydraulic actuators 103 that urge the platen 102 and attached die blank upward. The hydraulic actuators 103 raise the exposed face 52 of die blank 50 into operative engagement with the pattern forming tools 200 and 300. The amount of engagement of the pattern forming tools 200 and 300 with the face 52 of the blank 50 is controlled by the force imparted by the hydraulic actuators 103 to ensure cold forming deformation proceeds at the desired rate. Force may be increased as cold forming progresses up to 40,000 pounds or higher.

Since the interengagement of the pattern forming tools 200 and 300 and face 52 of die blank is controlled by force (as opposed to distance or interference) by maintaining a constant force it is possible to cold form the die blank even though the face is not planar, as is common in the stationary die profile and as is illustrated in FIG. 1.

In the machine of the present disclosure, two tools, initial pattern forming tool 200, and subsequent pattern forming tool 300 are utilized, sequentially, to create a thread rolling die thread form 54 on the face 52 of a blank 50. As an element of the drive mechanism, head 110 carries servo motor 112 that rotates a tool shaft 114 at a first tool station. The rotatable shaft 114 drives initial pattern forming tool 200. As a further element of the drive mechanism, head 110 also carries a further servo motor 113 that rotates a second tool shaft at a second tool station (See FIG. 5). The second rotatable shaft 115 drives subsequent pattern forming tool 300. The motor 111 driving the head linear actuator and the servo motors 112, 113 driving tool shafts 114, 115 are synchronized to rotate initial pattern forming tool 200 and subsequent pattern forming tool 300 reciprocally across a die face 52 at the appropriate speed and orientation to insure a rolling relationship without slippage.

The pattern forming tools 200 and 300 are sequentially placed in engaging contact with the pattern receiving face 52 of die blank 50. That is, subsequent pattern forming tool 300 is employed after deformation of the pattern receiving face 52 employing initial pattern forming tool 200 is complete. In each instance, the amount of interference or engagement of the pattern on the pattern forming tool 200 or 300 is controlled by positioning of the profile 202 or 302 relative to the pattern receiving face 52 of die 50. Using cylinders 103 it is contemplated that a given predetermined interference results in a particular force requirement to maintain the engagement as the pattern forming tool reciprocally traverses the pattern receiving face in rolling engagement. Such force requirement is reflected, for example, by the output torque of the drive servo motor 112 or 113. The force to maintain the requisite interference may therefore be recognized by monitoring servo motor output torque. It is then controlled by maintaining that torque at a constant level by adjustment of the force applied by cylinders 103 to create the interference or engagement. In this manner, the force may be maintained constant regardless of the surface profile of face 52.

As deformation of face 52 progresses, the force requirement would decrease. By adjustment of the cylinder pressure of cylinders 103, the interference can be readjusted to attain the predetermined force requirement.

Figure 5:
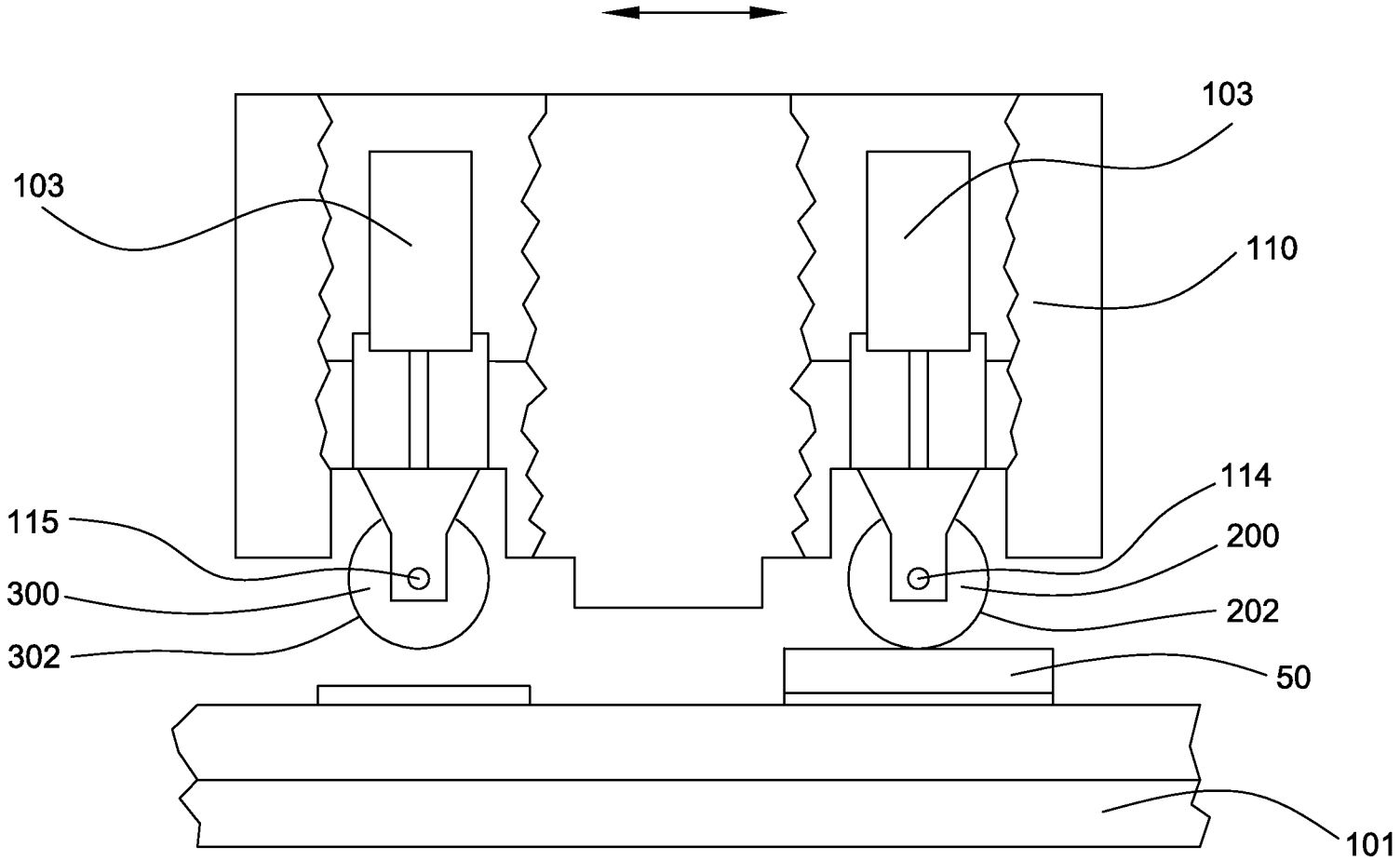
FIG. 5 is a partially broken away side view of the cold forming apparatus of the present disclosure.
Figure 6:
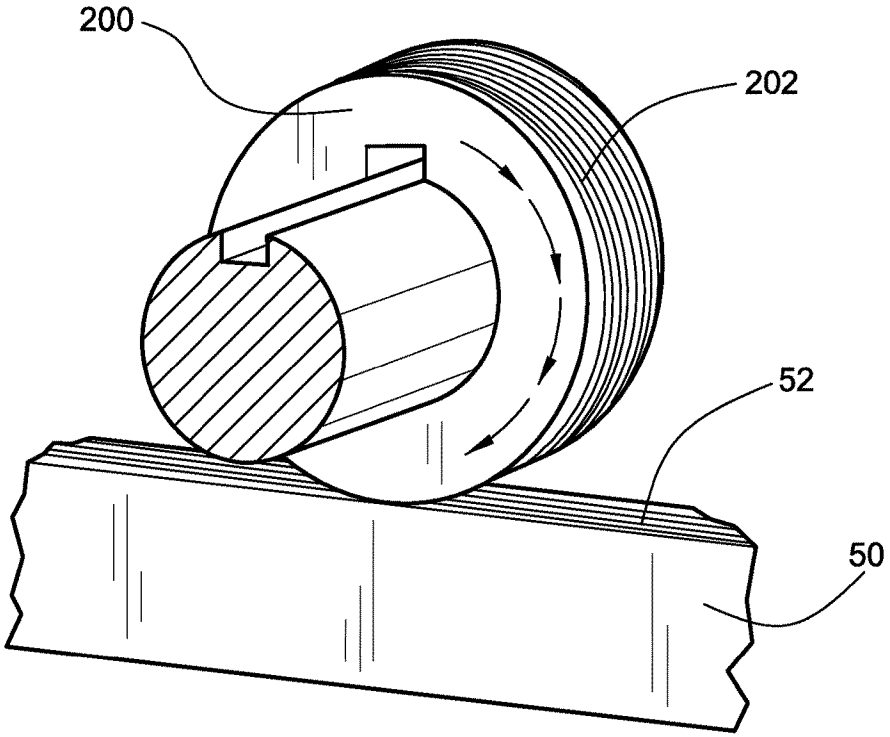
FIG. 6 is a side perspective view of the pattern forming tool of the present disclosure coacting with a thread forming die to which a thread form is imparted.
Figure 7:
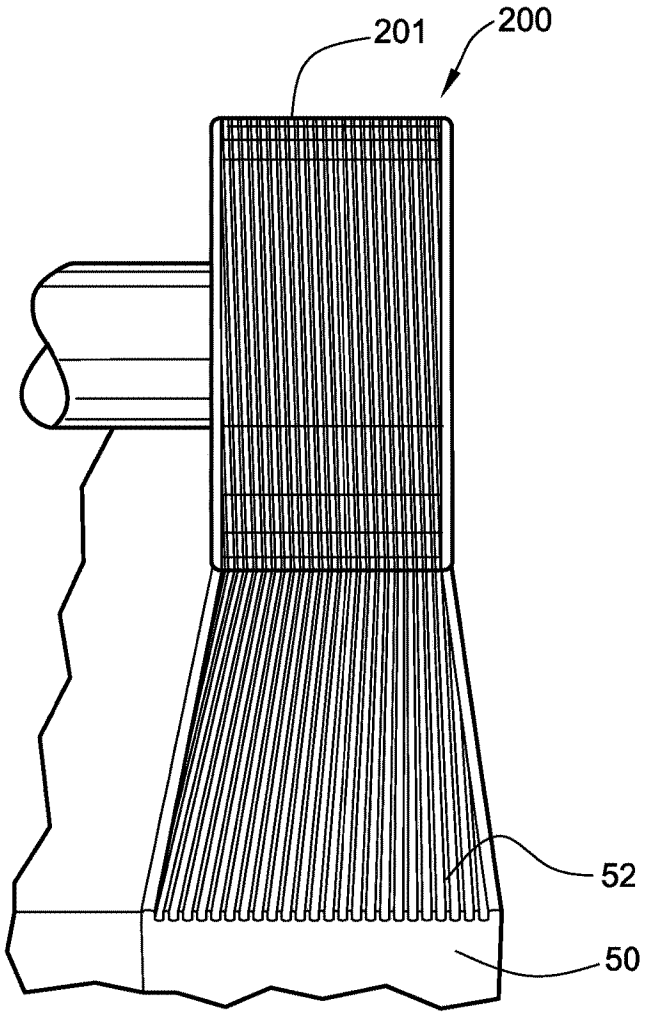
FIG. 7 is an end perspective view of the pattern forming tool of the present disclosure and the thread forming die of FIG. 6.

Seen in FIGS. 6 and 7, initial pattern forming tool 200 is a cylinder, with a ridge profile 202 impressed upon its outer cylindrical surface. Similarly subsequent pattern forming tool 300 is a cylinder with a ridge profile 302 impressed on its outer surface. The tools are formed by milling, grinding and polishing (See FIGS. 5, 8 and 9).

The initial pattern forming tool 200 includes thread forming ridges 202 to impart an initial thread form to the face 52 of the thread rolling die 50. These ridges extend in a spiral pattern around the outer cylindrical surface of the tool. As the tool reciprocates longitudinally along the longitudinal length of the face 52 of the die blank 50 it deforms the blank in accordance with the pattern on the tool 200, and the interference between the tool and blank. As multiple reciprocal passes across the blank proceed, the interference is increased until the desired pattern is achieved. It is contemplated that tool 200 may execute forty (40) or more passes to impress the thread forming pattern onto surface 52.

The subsequent pattern forming tool 300 includes thread forming ridges 302 to impart a final thread form to the face 52 of the thread rolling die 50. The ridges extend in a spiral pattern around the outer cylindrical surface of the tool. As the tool reciprocates longitudinally along the longitudinal length of the face 52 of the die blank 50 it deforms the blank in accordance with the pattern on the tool 300, and the interference between the tool and blank. As multiple reciprocal passes across the blank proceed, the interference is increased until the desired pattern is achieved. It is contemplated that tool 300 may execute forty (40) or more passes to impress the thread forming pattern onto surface 52.

Figure 9:
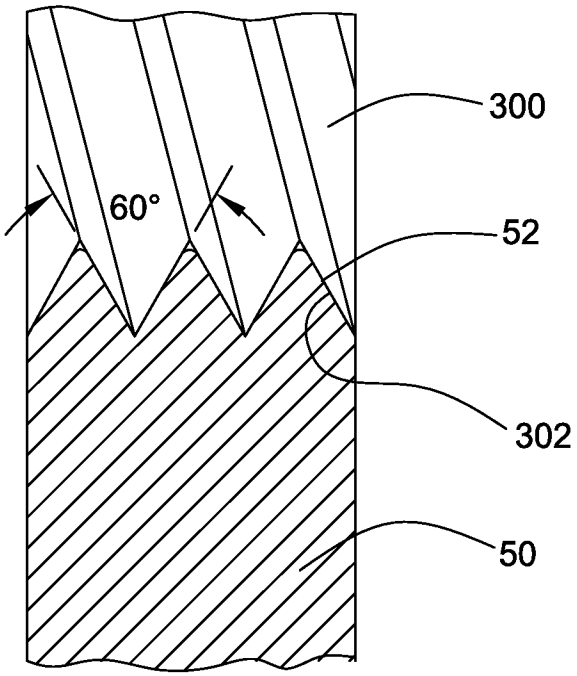
FIG. 9 is a fragmentary sectional view on an enlarged scale of a subsequent thread forming tool of the present disclosure and the thread forming die being created.
Figure 8:
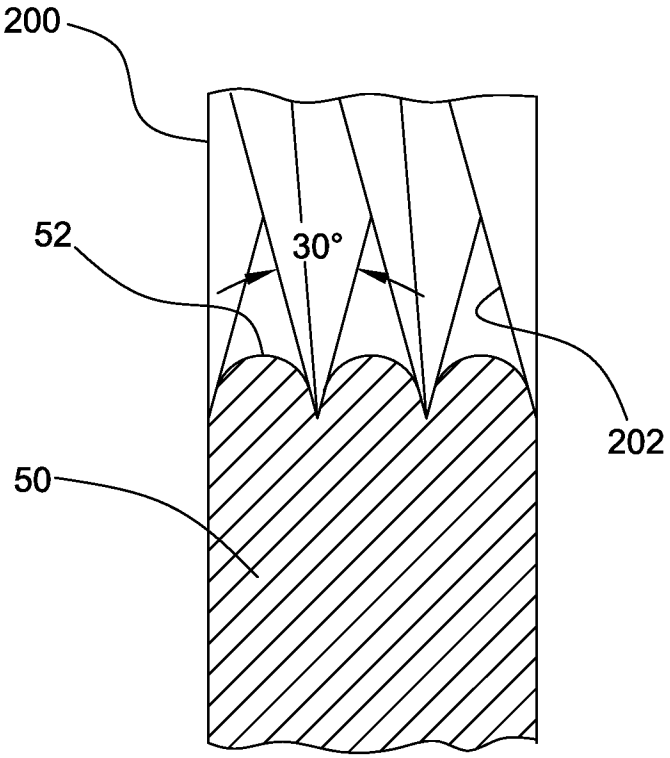
FIG. 8 is a fragmentary sectional view on an enlarged scale of an initial thread forming tool of the present disclosure and the thread forming die being created.

As seen in FIG. 8, the initial pattern forming tool 200 includes an initial thread profile 202 with ridges formed at an included angle of about thirty degrees (30°) or forty-five degrees (45°). This tool is used to provide initial deformation of the face 52 of the thread rolling die blank 50. Thereafter, as illustrated in FIG. 9, a subsequent pattern forming tool is provided with a final ridge profile 302 intended to impart the final shape to the thread form on the face of die blank 50. The ridges on the subsequent pattern forming tool 300 are formed at an included angle of sixty degrees (60°). These ridges are configured to define the root and crest profile of the intended fastener thread onto the face 52 of the die blank 50.

The subsequent cylindrical tool 300 may be powered by a second servo motor 113 at a second tool station on the same base. The second tool station is essentially identical to the first tool station and operates in the same way. Alternatively, only one tool station need by employed and the pattern forming tools 200 and 300 interchanged on the same shaft as needed.

In the embodiment illustrated, the platen 102 is slidable along base 101 to orient it with the second tool station. Such an arrangement is illustrated in FIG. 5, which also schematically depicts an arrangement where the force imparting cylinders 103 are mounted within the slidable head 110, rather than the stationary base 101.

Figure 10:
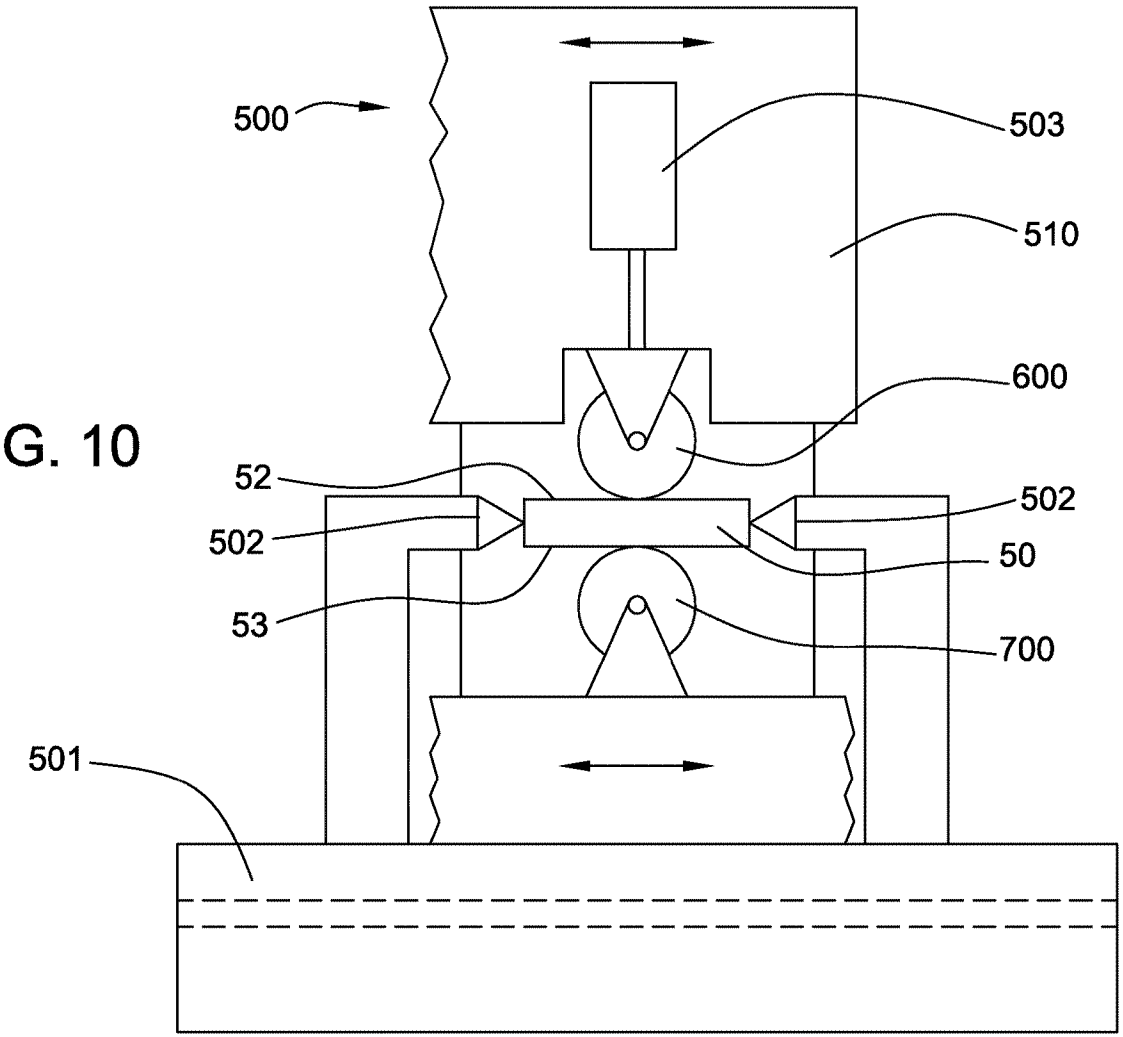
FIG. 10 is a side view of an alternative configuration of an apparatus for cold forming dies in accordance with the disclosure.

A further modified form of cold forming die is illustrated in FIG. 10. Here the pattern of thread forming ridges are simultaneously impressed upon both front and back faces 52 and 53 of die blank 50. The die blank 50 is held stationary on a platen 502 with opposite rectangular faces 52 and 53 exposed.

The machine 500 is equipped with two sets of opposed cylindrical pattern forming tools 600 and 700. These tools are driven by servo motors in synchronization with reciprocal movement of the head 510 relative to base 501. Actuators 503 urge the tools into operative contact with both longitudinal surfaces 52 and 53 of the die blank 50 to roll thread pattern onto both faces simultaneously. In this embodiment, it is contemplated that tools 600 and 700 are the same as initial pattern forming tool 200 and impress an initial, pattern on faces 52 and 54 with, for example, a thirty degree (30°) thread profile. Thereafter, a pair of subsequent pattern forming tools identical to tool 300 with a 60° ridge cross section would be used to finish the thread configuration on faces 52 and 54. These subsequent pattern forming tools would, for example, replace tools 600 and 700 in the machine 500 for the final rolling operation.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

The invention claimed is:

1. A method of roll forming a face pattern onto a pattern forming die comprising:

providing a forming die blank having a pattern receiving face;

providing an initial pattern forming tool having a generally cylindrical pattern defining surface;

engaging said generally cylindrical pattern defining surface of said initial pattern forming tool with said pattern receiving face of said forming die blank;

urging one of said generally cylindrical pattern defining surface of said initial pattern forming tool and said pattern receiving face of said forming die blank into the other to impress the pattern of said generally cylindrical pattern defining surface of said initial pattern forming tool into said pattern receiving face of said forming die blank;

reciprocating said initial pattern forming tool relative to said forming die blank via a first motor coupled to a linear actuator during the engagement between said generally cylindrical pattern defining surface of said initial pattern forming tool and said pattern receiving face of said forming die blank;

rotating said initial pattern forming tool relative to said forming die blank via a second motor separate and distinct from the first motor, the second motor coupled to the initial pattern forming tool via a shaft during the engagement between said generally cylindrical pattern defining surface of said initial pattern forming tool and said pattern receiving face of said forming die blank and during said relative reciprocal movement; and maintaining a constant force between said engaged generally cylindrical pattern defining surface of said initial pattern forming tool and said non-planar pattern receiving face of said pattern forming die during said relative reciprocal and rotational movement therebetween, wherein said pattern receiving face of said forming die blank is a non-planar pattern receiving face.

2. The method of roll forming a face pattern onto a pattern forming die as claimed in claim 1, the method further comprising:

providing a subsequent pattern forming tool having a generally cylindrical pattern defining surface, wherein the subsequent pattern forming tool is discrete and spaced apart from the initial pattern forming tool;

relatively reciprocating and rotating said pattern defining surface of said subsequent pattern forming tool and said pattern receiving face of said forming die blank;

engaging said generally cylindrical pattern defining surface of said subsequent pattern forming tool with said pattern receiving face of said forming die blank after the pattern of said generally cylindrical pattern defining surface of said initial pattern forming tool has been impressed into said pattern receiving face of said forming die blank; and urging together said generally cylindrical pattern defining surface of said subsequent pattern forming tool and said pattern receiving face of said forming die blank to provide the face pattern with a thread form onto the pattern forming die.

3. The method of roll forming a face pattern onto a pattern forming die as claimed in claim 2, the method further comprising:

maintaining a constant force between said engaged generally cylindrical pattern defining surface of said subsequent pattern forming tool and said pattern receiving face of said forming die blank during said urging and relative reciprocal and rotational movement therebetween.

4. The method of roll forming a face pattern onto a pattern forming die as claimed in claim 1, wherein said generally cylindrical pattern defining surface of said initial pattern forming tool comprises a spiral thread pattern of ridges defining roots and crests.

5. The method of roll forming a face pattern onto a pattern forming die as claimed in claim 2, wherein said generally cylindrical pattern defining surface of said initial pattern forming tool comprises a spiral thread pattern of ridges defining roots and crests, said generally cylindrical pattern defining surface of said subsequent pattern forming tool comprises a spiral pattern of ridges defining roots and crests, and the included angle of said ridges on said generally cylindrical pattern defining surface of said subsequent pattern forming tool is a greater included angle than the included angle of said ridges on said generally cylindrical pattern defining surface of said initial pattern forming tool.

6. The method of roll forming a face pattern onto a pattern forming die as claimed in claim 5, wherein the included angle of said ridges on said generally cylindrical pattern defining surface of said initial pattern forming tool is thirty degrees (30°) and the included angle of said ridges on said generally cylindrical pattern defining surface of said subsequent pattern forming tool is sixty degrees (60°).

7. The method of roll forming a face pattern onto a pattern forming die as claimed in claim 1, the method further comprising:

maintaining said die blank stationary and rotating and reciprocating said initial pattern forming tool relative thereto.

8. The method of roll forming a face pattern onto a pattern forming die as claimed in claim 2, the method further comprising:

maintaining said die blank stationary and rotating and reciprocating said initial pattern forming tool and said subsequent pattern forming tool relative thereto.

9. The method of roll forming the face pattern onto a pattern forming die as claimed in claim 2, the method further comprising:

providing a forming die blank having an additional, oppositely facing pattern receiving face;

providing a second, initial pattern forming tool having a generally cylindrical pattern defining surface;

relatively reciprocating and rotating said pattern defining surface of said second initial pattern forming tool and said additional pattern receiving face of said forming die blank;

engaging said generally cylindrical pattern defining surface of said second initial pattern forming tool with said additional pattern receiving face of said forming die blank;

urging together said generally cylindrical pattern defining surface of said second initial pattern forming tool and said additional pattern receiving face of said forming die blank to provide the face pattern with a thread form onto the pattern forming die;

providing a second subsequent pattern forming tool having a generally cylindrical pattern defining surface;

relatively reciprocating and rotating said pattern defining surface of said second subsequent pattern forming tool and said additional pattern receiving face of said forming die blank;

engaging said generally cylindrical pattern defining surface of said second subsequent pattern forming tool with said additional pattern receiving face of said forming die blank after the pattern of said generally cylindrical pattern defining surface of said second initial pattern forming tool has been impressed into said additional pattern receiving face of said forming die blank; and urging together said generally cylindrical pattern defining surface of said second subsequent pattern forming tool and said additional pattern receiving face of said forming die blank to provide the face pattern with a thread form onto the pattern forming die.

10. The method of roll forming a face pattern onto a pattern forming die as claimed in claim 1, wherein said engaging comprises directly urging said pattern receiving face of said forming die blank into said initial pattern forming tool.

11. The method of roll forming a face pattern onto a pattern forming die as claimed in claim 1, wherein said forming die blank is non-cylindrical.

12. The method of roll forming a face pattern onto a pattern forming die as claimed in claim 1, wherein said urging comprises imparting a rolled thread onto said pattern receiving face of said forming die blank.

13. An apparatus for roll forming a face pattern onto a pattern forming die comprising:

a platen for supporting a forming die blank having a pattern receiving face that is non-planar;

an initial pattern forming tool having a generally cylindrical pattern defining surface;

a drive mechanism for relatively reciprocating and rotating said pattern defining surface of said initial pattern forming tool and said pattern receiving face of said forming die blank, the drive mechanism including a first motor coupled to a linear actuator to drive the reciprocating of said initial pattern forming tool relative to said forming die blank, the drive mechanism further including a second motor separate and distinct from the first motor, the second motor coupled to the initial pattern forming tool via a shaft to drive the rotating of said initial pattern forming tool relative to said forming die blank, wherein the first motor and the second motor operate during a common time period to provide the relative reciprocal and rotational movement; and a relative movement mechanism for engaging said generally cylindrical pattern defining surface of said initial pattern forming tool with said pattern receiving face of said forming die blank for urging together said generally cylindrical pattern defining surface of said initial pattern forming tool and said pattern receiving face of said forming die blank to provide the face pattern with a thread form onto the pattern forming die, said relative movement mechanism configured to maintain a constant force between said engaged generally cylindrical pattern defining surface of said initial pattern forming tool and said pattern receiving face of said pattern forming die during said urging and relative reciprocal and rotational movement therebetween.

14. An apparatus for roll forming a face pattern onto a pattern forming die as claimed in claim 13, further comprising:

a subsequent pattern forming tool having a generally cylindrical pattern defining surface, wherein the subsequent pattern forming tool is discrete and spaced apart from the initial pattern forming tool;

a drive mechanism for relatively reciprocating and rotating said pattern defining surface of said subsequent pattern forming tool and said pattern receiving face of said forming die blank; and relative movement mechanism for engaging said generally cylindrical pattern defining surface of said subsequent pattern forming tool with said pattern receiving face of said forming die blank after the face pattern has been impressed onto the pattern forming die for urging together said generally cylindrical pattern defining surface of said subsequent pattern forming tool and said pattern receiving face of said forming die blank to provide the face pattern with a thread form onto the pattern forming die.

15. An apparatus for roll forming a face pattern onto a pattern forming die as claimed in claim 14, further comprising:

said relative movement mechanism configured to maintain a constant force between said engaged generally cylindrical pattern defining surface of said subsequent pattern forming tool and said pattern receiving face of said forming die blank during said urging and relative reciprocal and rotational movement therebetween.

16. An apparatus for roll forming a face pattern onto a pattern forming die as claimed in claim 13 wherein said generally cylindrical pattern defining surface of said initial pattern forming tool comprises a spiral thread pattern of ridges defining roots and crests.

17. An apparatus for roll forming a face pattern onto a pattern forming die as claimed in claim 14, wherein said generally cylindrical pattern defining surface of said initial pattern forming tool comprises a spiral thread pattern of ridges defining roots and crests, and wherein said generally cylindrical pattern defining surface of said subsequent pattern forming tool comprises a spiral pattern of ridges defining roots and crests, such that the included angle of said ridges on said generally cylindrical pattern defining surface of said subsequent pattern forming tool is a greater included angle than the included angle of said ridges on said generally cylindrical pattern defining surface of said initial pattern forming tool.

18. An apparatus for roll forming a face pattern onto a pattern forming die as claimed in claim 17, wherein the included angle of said ridges on said generally cylindrical pattern defining surface of said initial pattern forming tool is thirty degrees (30°), and wherein the included angle of said ridges on said generally cylindrical pattern defining surface of said subsequent pattern forming tool is sixty degrees (60°).

19. An apparatus for roll forming a face pattern onto a pattern forming die as claimed in claim 13, wherein said platen of said relative movement mechanism is stationary and said drive mechanism rotates and reciprocates said initial pattern forming tool relative thereto.

20. The apparatus for roll forming a face pattern onto a pattern forming die as claimed in claim 13, wherein said platen is moveable to directly urge said forming die block into said initial pattern forming tool.

21. The apparatus for roll forming a face pattern onto a pattern forming die as claimed in claim 13, wherein said forming die blank is non-cylindrical.

22. The apparatus for roll forming a face pattern onto a pattern forming die as claimed in claim 13, wherein said relative movement mechanism imparts a rolled thread onto said pattern receiving face of said forming die blank.

23. The apparatus for roll forming a face pattern onto a pattern forming die as claimed in claim 13, wherein the first motor and the second motor are synchronized to drive rotation of the pattern defining surface of the initial pattern forming tool across the pattern receiving face of the forming die blank while driving linear reciprocal movement of the initial pattern forming tool relative to the forming die blank to provide a rolling relationship without slippage.

24. The apparatus for roll forming a face pattern onto a pattern forming die as claimed in claim 13, wherein the platen is stationary and the drive mechanism further includes a head that is coupled to the linear actuator and reciprocally movable relative to the platen and the die forming blank by the first motor, wherein the head holds the initial pattern forming tool and the second motor such that the initial pattern forming tool and the second motor are reciprocally moved relative to the platen and the die forming blank by the first motor.

25. The apparatus for roll forming a face pattern onto a pattern forming die as claimed in claim 13, wherein the platen is for supporting the forming die blank that includes the pattern receiving face which has a middle planar region between two tapered end regions, and wherein the first motor of the drive mechanism drives reciprocal movement of said pattern defining surface of said initial pattern forming tool across said pattern receiving face of said forming die blank along each of the middle planar region and the two tapered end regions while maintaining engagement between said pattern defining surface and said pattern receiving face.

26. An apparatus for roll forming at least one face pattern onto a forming die blank, the apparatus comprising:

a platen for supporting a forming die blank having a first face and a second face that is opposite from said first face, at least one of said first face and said second face is non-planar;

a first pattern forming having a first cylindrical pattern defining surface;

a second pattern forming having a second cylindrical pattern defining surface, wherein said second pattern forming tool is spaced a distance from said first pattern forming along opposite sides of the platen and the forming die blank;

a drive mechanism for relatively reciprocating and rotating said first and second pattern defining surfaces of said first and second pattern forming tools and said first and said second faces of said forming die blank, wherein the drive mechanism includes a first motor coupled to the platen via a linear actuator to drive the reciprocating of said forming die blank relative to said first and second pattern forming tools, the drive mechanism further including a second motor and a third motor, the second motor coupled to the first pattern forming tool to drive the rotating of said first pattern forming tool relative to said forming die blank, the third motor coupled to the second pattern forming tool to drive the rotating of said second pattern forming tool relative to said forming die blank, wherein the first motor, the second motor, and the third motor operate during a common time period to provide the relative reciprocal and rotational movement; and a relative movement mechanism for engaging said first and second cylindrical pattern defining surfaces of said first and second pattern forming tools with said first and second faces of said forming die blank, respectively, for urging said first and second cylindrical pattern defining surfaces of said first and second pattern forming tools into said first and second faces of said forming die blank to provide patterns of said first and second cylindrical pattern defining surfaces of said first and second pattern forming tools into said first and second faces of said forming die blank.

* * * * *